US009785083B2

(12) United States Patent
Morishita et al.

(10) Patent No.: US 9,785,083 B2
(45) Date of Patent: Oct. 10, 2017

(54) IMAGE FORMING APPARATUS INCLUDING BEARING CONFIGURED TO ROTATABLY SUPPORT CHARGING MEMBER WHICH COMES INTO CONTACT WITH OR SEPARATES FROM IMAGE CARRIER

(71) Applicant: KYOCERA Document Solutions Inc., Osaka (JP)

(72) Inventors: Hiroki Morishita, Osaka (JP); Nobuhiro Nishioka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/286,789

(22) Filed: Oct. 6, 2016

(65) Prior Publication Data

US 2017/0139340 A1 May 18, 2017

(30) Foreign Application Priority Data

Nov. 12, 2015 (JP) ..... 2015-222227

(51) Int. Cl.
*G03G 15/02* (2006.01)

(52) U.S. Cl.
CPC ..... *G03G 15/0258* (2013.01); *G03G 15/0216* (2013.01)

(58) Field of Classification Search
CPC ..... G03G 15/0216; G03G 15/0225; G03G 15/0258; G03G 2215/021
USPC ..... 399/100, 115, 174, 176
See application file for complete search history.

(56) References Cited

U.S. PATENT DOCUMENTS 5,465,136 A * 11/1995 Watanabe ..... G03G 15/0216 399/115
7,720,412 B2 * 5/2010 Anan ..... G03G 21/1821 399/115
7,890,016 B2 2/2011 Ota
8,761,635 B2 * 6/2014 Lee ..... G03G 21/1814 399/115
2006/0251447 A1 * 11/2006 Baek ..... G03G 15/0216 399/176
2011/0069989 A1 * 3/2011 Kim ..... G03G 15/0216 399/115

FOREIGN PATENT DOCUMENTS

JP 2009-047911 A 3/2009

* cited by examiner

*Primary Examiner* — Sophia S Chen
(74) *Attorney, Agent, or Firm* — Studebaker & Brackett PC

(57) ABSTRACT

An image forming apparatus includes a unit and an apparatus main body. The unit includes a charging member configured to charge an image carrier and a bearing configured to rotatably support the charging member. To the apparatus main body, the unit is attached along an attachment direction. The bearing is switchable between a contact posture to make the charging member come into contact with the image carrier and a separating posture to make the charging member separate from the image carrier. In a state before the unit is attached to the apparatus main body, the bearing is held in the separating posture. As the unit is attached to the apparatus main body, a pressing part arranged on the apparatus main body presses the bearing and the bearing is switched from the separating posture to the contact posture.

6 Claims, 18 Drawing Sheets

IMAGE FORMING APPARATUS INCLUDING BEARING CONFIGURED TO ROTATABLY SUPPORT CHARGING MEMBER WHICH COMES INTO CONTACT WITH OR SEPARATES FROM IMAGE CARRIER

INCORPORATION BY REFERENCE

This application is based on and claims the benefit of priority from Japanese patent application No. 2015-222227 filed on Nov. 12, 2015, which is incorporated by reference in its entirety.

BACKGROUND

The present disclosure relates to an image forming apparatus, and more particularly, to an image forming apparatus including a charging member configured to charge an image carrier.

Conventionally, an image forming apparatus, such as a printer, a copying machine, a facsimile, and a multi-function peripheral (MFP), includes a charging member configured to charge an image carrier, such as a photosensitive drum. For example, there is an image forming apparatus which includes a unit including a charging member configured to charge an image carrier and an apparatus main body to which the unit is attached.

In the image forming apparatus with such a configuration, when a pressure contact state of the image carrier and the charging member is kept for a long time, the image carrier and/or the charging member may be deformed as time goes by. Such a situation may make it impossible for the charging member to charge the image carrier uniformly, and may cause a defective image.

In light of such a problem, a known image forming apparatus has a configuration that a charging member separates from an image carrier when a unit is not in use (e.g. when the unit is stored) and the charging member comes into contact with the image carrier by a manual operation of a worker, such as a service man, when the unit starts to be used.

SUMMARY

In accordance with an embodiment of the present disclosure, an image forming apparatus includes a unit and an apparatus main body. The unit includes a charging member configured to charge an image carrier and a bearing configured to rotatably support the charging member. To the apparatus main body, the unit is attached along an attachment direction. The bearing is switchable between a contact posture to make the charging member come into contact with the image carrier and a separating posture to make the charging member separate from the image carrier. In a state before the unit is attached to the apparatus main body, the bearing is held in the separating posture. As the unit is attached to the apparatus main body, a pressing part arranged on the apparatus main body presses the bearing and the bearing is switched from the separating posture to the contact posture.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, an MFP 1 (image forming apparatus) according to an embodiment of the present disclosure will be described with reference to the drawings. Arrows Fr, Rr, L, R, U and Lo optionally added to each drawing indicate a front side, a rear side, a left side, a right side, an upper side and a lower side of the MFP 1, respectively.

First, an outline of the configuration of the MFP 1 will be described.

Figure 1:
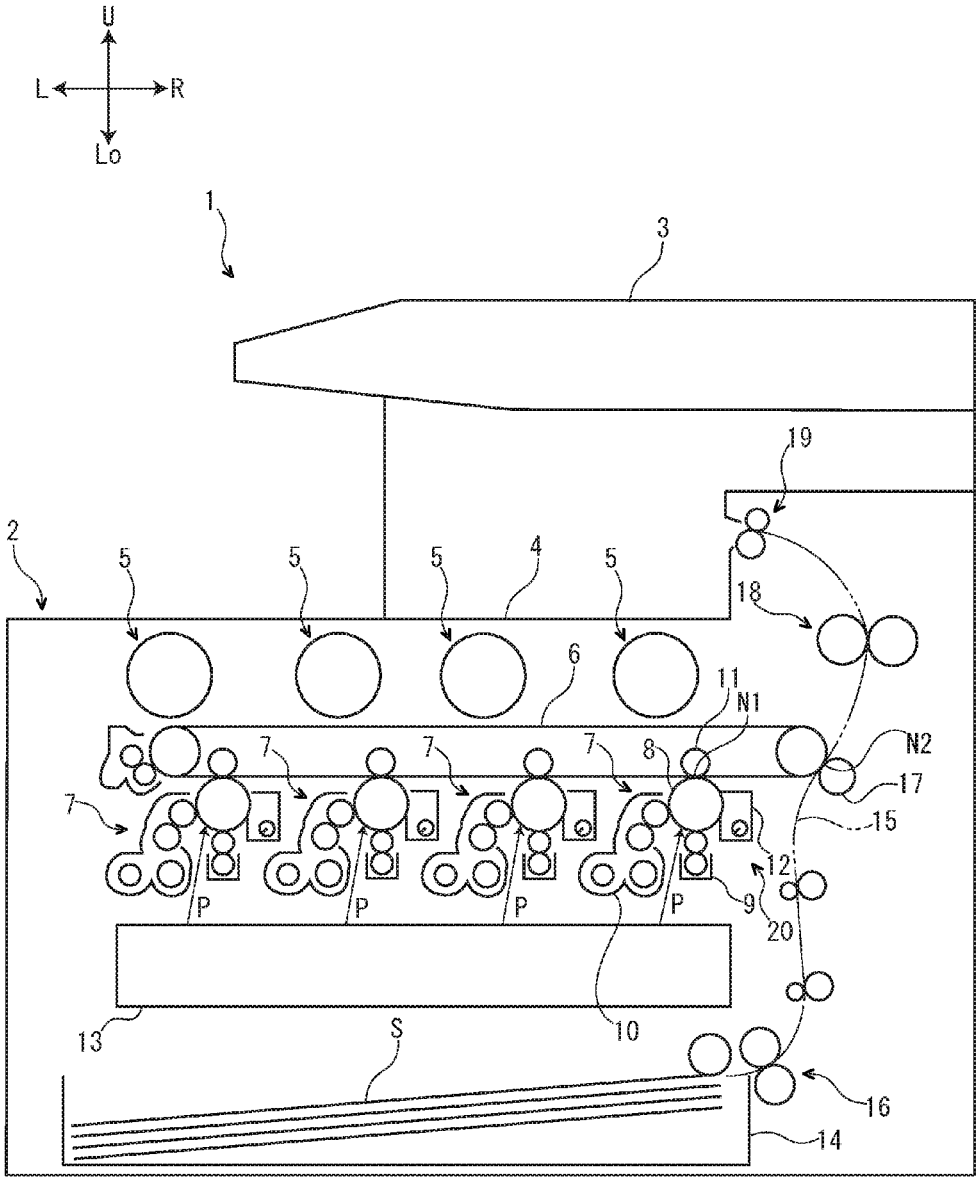
FIG. 1 is a schematic view showing an outline of a multi-function peripheral (MFP) according to an embodiment of the present disclosure.

As shown in FIG. 1, the MFP 1 includes a box-formed MFP main body 2 (an apparatus main body). In an upper end part of the MFP main body 2, an image reading device 3 to read an original image is arranged. In an upper part of the MFP main body 2, a sheet ejecting tray 4 is arranged below the image reading device 3. In the upper part of the MFP main body 2, four toner containers 5 are arranged below the sheet ejecting tray 4. The four toner containers 5 correspond to toners of yellow, magenta, cyan, and black in an order from the left side to the right side.

In a roughly middle part of the MFP main body 2, an intermediate transfer belt 6 is housed below the four toner containers 5. In the roughly middle part of the MFP main body 2, four image forming parts 7 are housed below the intermediate transfer belt 6. The four image forming parts 7 correspond to toners of yellow, magenta, cyan, and black in the order from the left side to the right side. Each image forming part 7 includes a photosensitive drum 8 (an image carrier), a charging device 9, a developing device 10, a primary transfer roller 11, and a cleaning device 12. The primary transfer roller 11 sandwiches the intermediate transfer belt 6 with the photosensitive drum 8 so as to form a primary transfer nip N1 between the intermediate transfer belt 6 and the photosensitive drum 8. The photosensitive drum 8, the charging device 9, and the cleaning device 12 are integrated as a drum unit 20, which is described in detail later.

In a lower part of the MFP main body 2, an exposure device 13 is housed below the four image forming parts 7. In a lower end part of the MFP main body 2, a sheet feeding tray 14 is housed below the exposure device 13. In the sheet feeding tray 14, a sheet S (a recording medium) is accommodated.

At a right side part of the MFP main body 2, a conveying path 15 for the sheet S is arranged. At a lower end part (an upstream end part) of the conveying path 15, a sheet feeding part 16 is arranged. At an intermediate stream part of the conveying path 15, a secondary transfer roller 17 is arranged. Between the secondary transfer roller 17 and the intermediate transfer belt 6, a secondary transfer nip N2 is formed. At an upper part (a downstream part) of the conveying path 15, a fixing device 18 is arranged. At an upper end part (a downstream end part) of the conveying path 15, a sheet ejecting part 19 is arranged.

Next, an operation of the MFP 1 with such a configuration will be described.

When an instruction to start printing is given to the MFP 1, firstly, the charging device 9 electrically charges a surface of the photosensitive drum 8. Then, an electrostatic latent image is formed on the surface of the photosensitive drum 8 by a laser light (refer to an arrow P in FIG. 1) from the exposure device 13. Then, the developing device 10 supply a toner to the photosensitive drum 8, so that the electrostatic latent image formed on the surface of the photosensitive drum 8 is developed and a toner image is carried by the photosensitive drum 8. This toner image is primarily transferred to a surface of the intermediate transfer belt 6 at the primary transfer nip N1. Such an operation is carried out at each image forming part 7 to form a full color toner image on the intermediate transfer belt 6. Incidentally, a toner remained on the photosensitive drum 8 is removed by the cleaning device 12.

On the other hand, the sheet S picked from the sheet feeding tray 14 by the sheet feeding part 16 is conveyed to a downstream side of the conveying path 15 and enters the secondary transfer nip N2. At the secondary transfer nip N2, the full color toner image formed on the intermediate transfer belt 6 is secondarily transferred to the sheet S. The sheet S to which the toner image is secondarily transferred is further conveyed to the downstream side of the conveying path 15 and enters the fixing device 18. At the fixing device 18, the toner image is fixed on the sheet S. The sheet S on which the toner image is fixed is ejected on the sheet ejecting tray 4 by the sheet ejecting part 19.

Next, the drum unit 20 will be described in detail.

Figure 2:
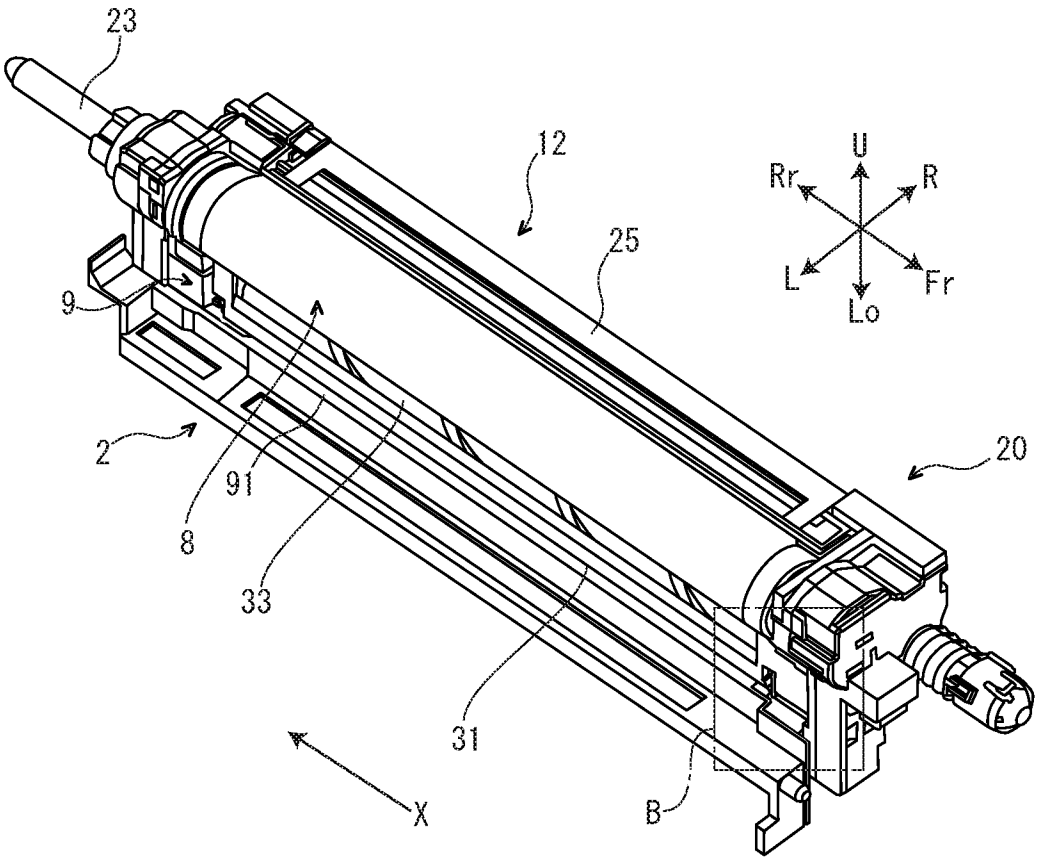
FIG. 2 is a perspective view showing a state that an attachment of a drum unit to an MFP main body is finished, in the MFP according to the embodiment of the present disclosure.

As shown in FIG. 2 and other figures, the drum unit 20 is formed in a shape elongated in a front and rear direction. The drum unit 20 is configured to be pushed toward the rear side and be attached to the MFP main body 2 along the front and rear direction. An arrow X optionally assigned in each figure indicates an attachment direction (the front and rear direction) of the drum unit 20 to the MFP main body 2. The "attachment direction" simply described below indicates the attachment direction of the drum unit 20 to the MFP main body 2.

The drum unit 20 includes the photosensitive drum 8, the cleaning device 12 arranged at a right side of the photosensitive drum 8, and a charging device 9 arranged at a lower side of the photosensitive drum 8. Hereinafter, these components will be described in order.

First, the photosensitive drum 8 of the drum unit 20 will be described.

The photosensitive drum 8 is formed in a cylindrical shape elongated in the front and rear direction. The photosensitive drum 8 is composed of an amorphous silicon or an organic photosensitive body, for example. The photosensitive drum 8 is rotatable around a drum shaft 23. The photosensitive drum 8 is connected with a driving source (not shown) composed of a motor or the like.

Next, the cleaning device 12 of the drum unit 20 will be described.

Figure 3:
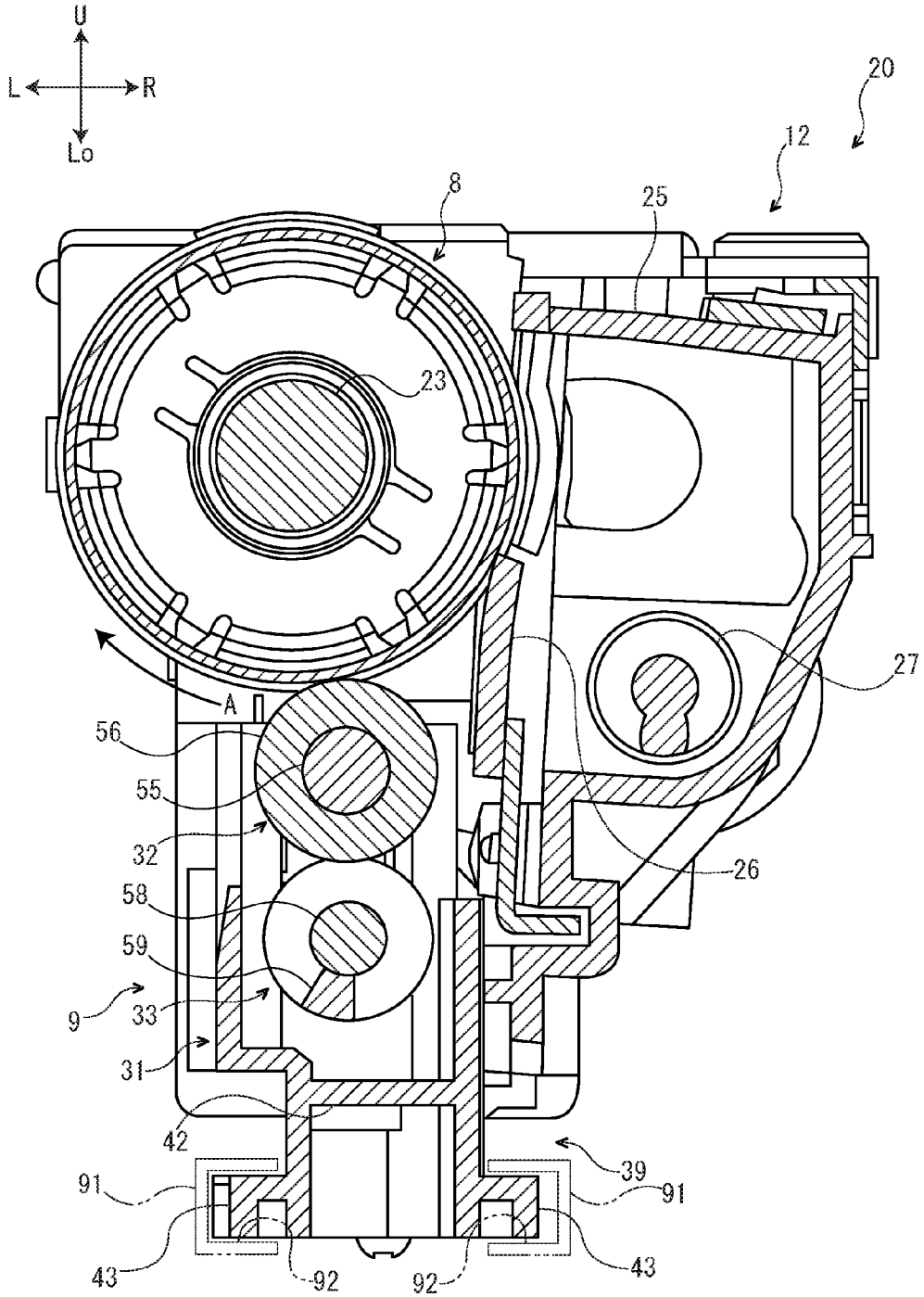
FIG. 3 is a sectional view showing a state that a charging roller comes into contact with a photosensitive drum and a cleaning roller comes into contact with the charging roller, in the drum unit according to the embodiment of the present disclosure.
Figure 4:
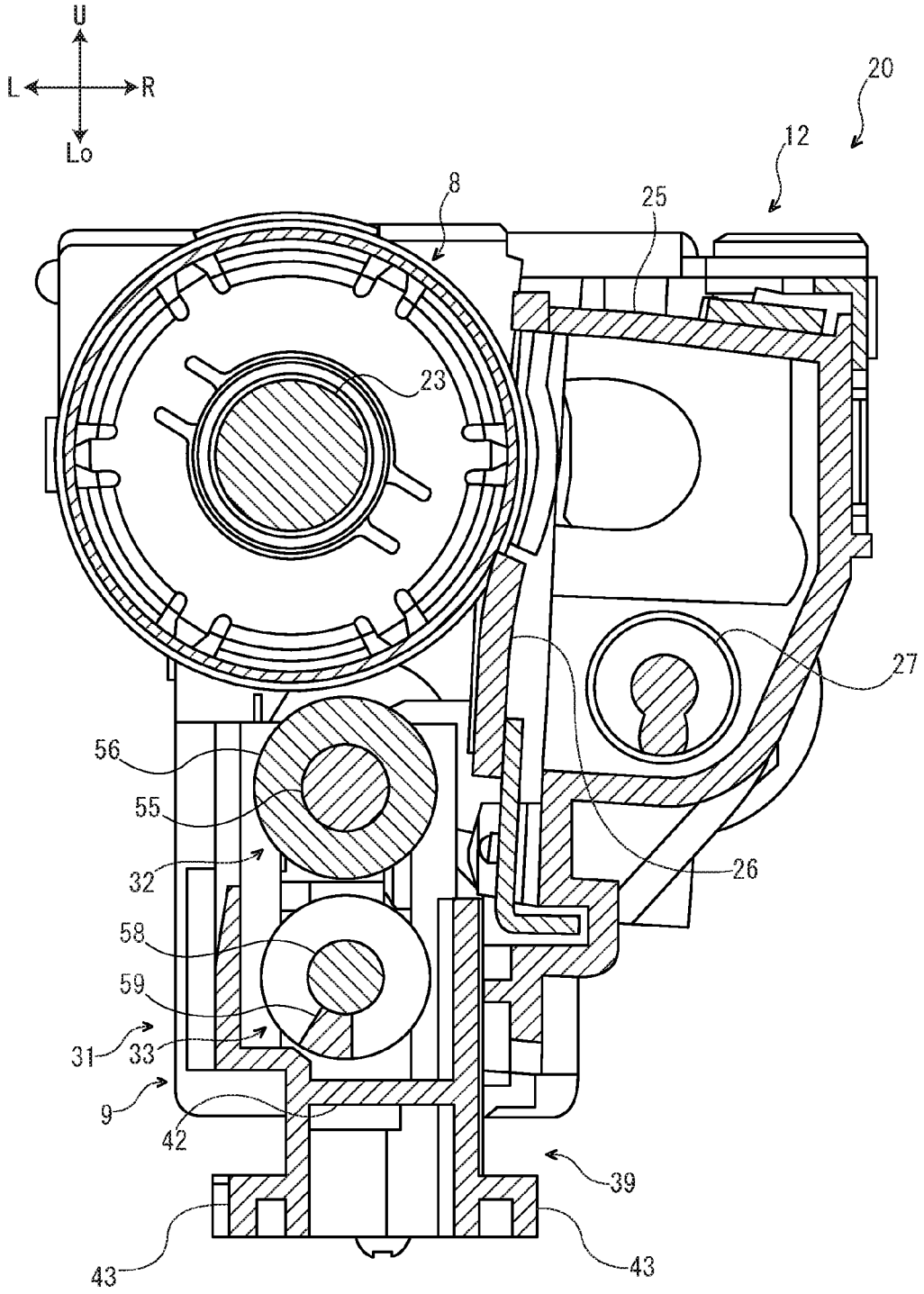
FIG. 4 is a sectional view showing a state that the charging roller separates from the photosensitive drum and the cleaning roller separates from the charging roller, in the drum unit according to the embodiment of the present disclosure.

As shown in FIGS. 3 and 4 and other figures, the cleaning device 12 includes a box-formed casing 25, a blade 26 which is attached to a lower left part of the casing 25 so as to come into contact with the photosensitive drum 8, and a screw 27 which is rotatably accommodated in a lower part of the casing 25. The toner removed from the photosensitive drum 8 by the blade 26 is conveyed by the screw 27, and is discharged to an outside of the casing 25 through a toner discharging port (not shown).

Next, the charging device 9 of the drum unit 20 will be described.

Figure 5:
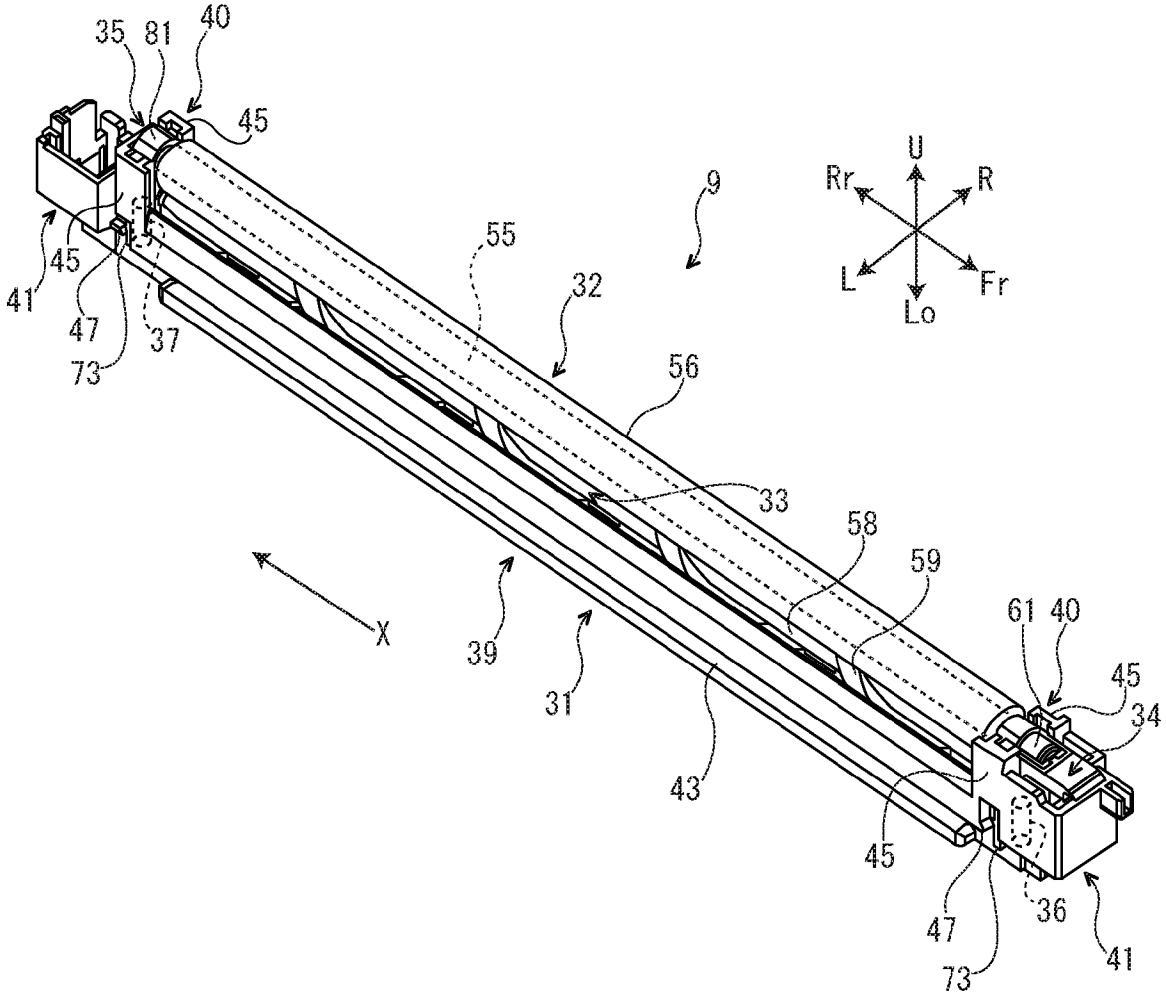
FIG. 5 is a perspective view showing a charging device according to the embodiment of the present disclosure.

The charging device 9 is integrated as a charging unit. As shown in FIG. 5 and other figures, the charging device 9 includes a frame 31, a charging roller 32 (a charging member) held at an upper part of the frame 31, a cleaning roller 33 (a cleaning member) held at a substantially center part of the frame 31, a front side bearing 34 (a near side bearing) held at a front part of the frame 31, a rear side bearing 35 (a far side bearing) held at a rear part of the frame 31, a front side coil spring 36 (a biasing member) arranged at a lower side of the front side bearing 34, and a rear side coil spring 37 (a biasing member) arranged at a lower side of the rear side bearing 35.

The frame 31 includes a main body part 39, a pair of guide parts 40 arranged at both front and rear outsides of the main body part 39, and a pair of case parts 41 arranged at both front and rear outsides of a pair of the guide parts 40.

As shown in FIGS. 3 and 4 and other figures, the main body part 39 of the frame 31 is formed in a box shape whose upper face and lower face are opened. An internal space of the main body part 39 is vertically partitioned by a partitioning wall 42. Elongated protrusions 43 are protruded on lower end parts of both left and right side faces of the main body part 39. As shown in FIG. 5 and other figures, each elongated protrusion 43 extends along the front and rear direction.

Figure 6:
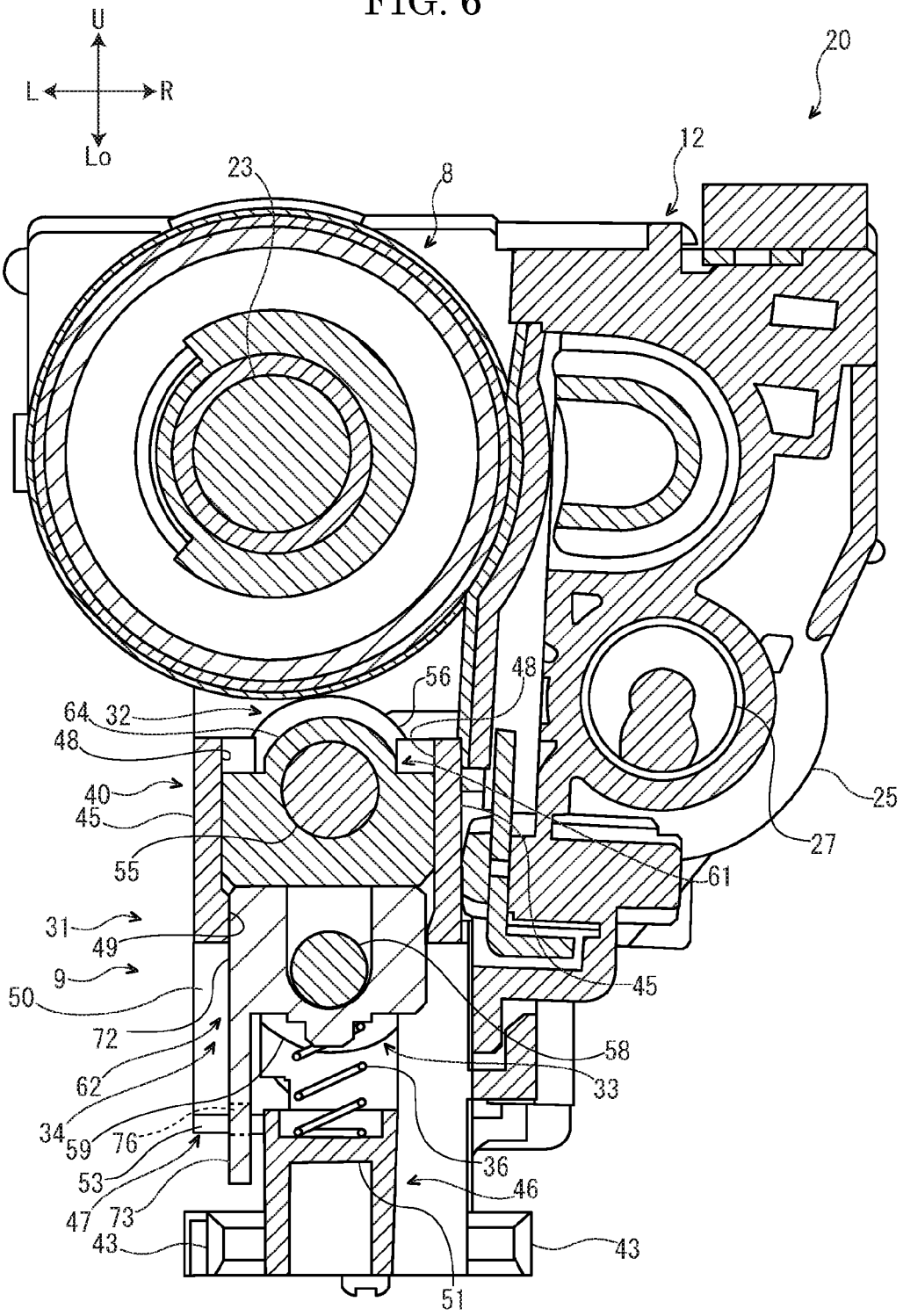
FIG. 6 is a sectional view showing a state that a front side bearing is in a contact posture, in the drum unit according to the embodiment of the present disclosure.
Figure 7:
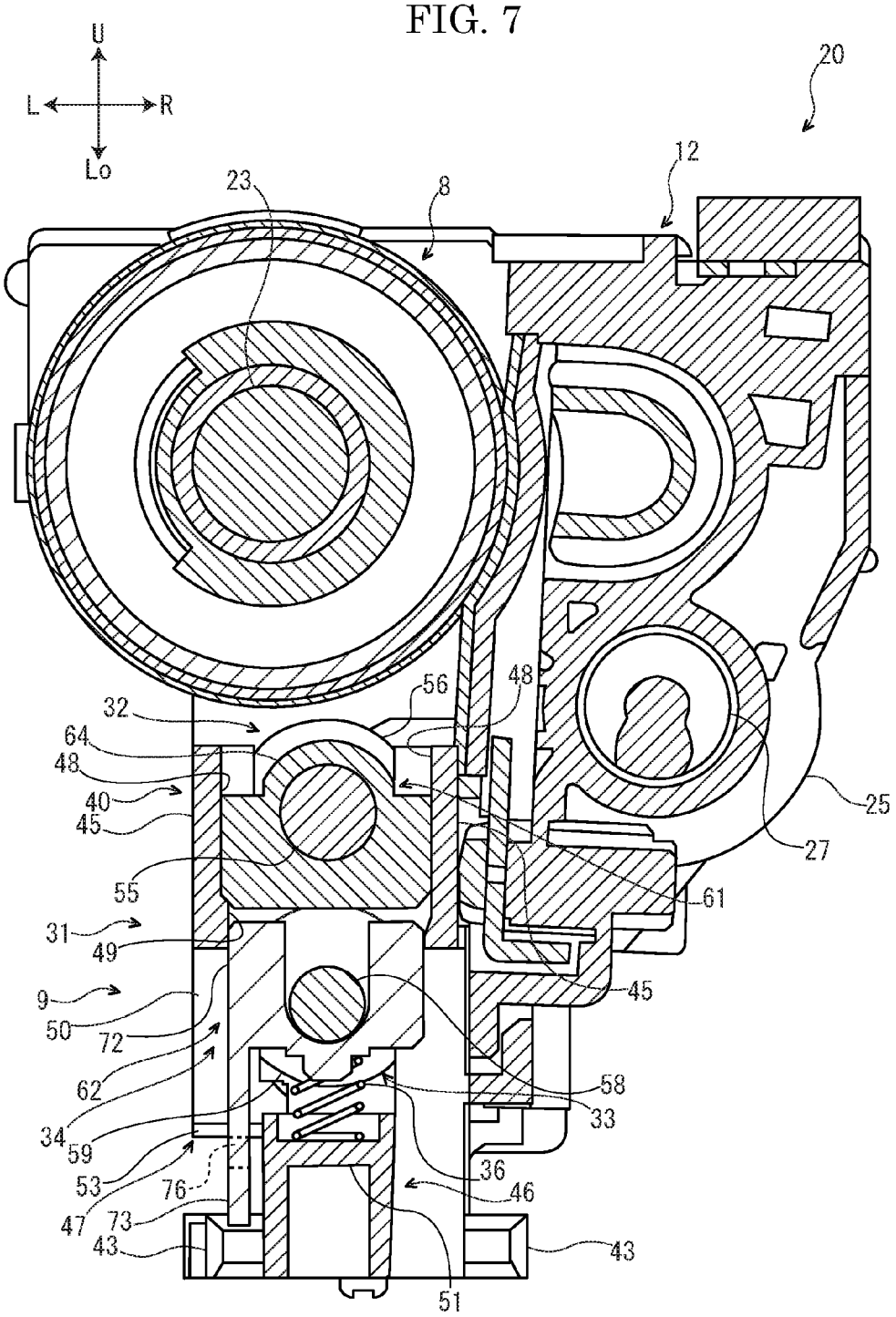
FIG. 7 is a sectional view showing a state that the front side bearing is in a separating posture, in the drum unit according to the embodiment of the present disclosure.

As shown in FIGS. 6 and 7 and other figures, each guide part 40 of the frame 31 includes a pair of left and right guide pieces 45, a guide frame 46 arranged below a pair of the left and right guide pieces 45 and an engagement rib 47 arranged at an upper left side of the guide frame 46.

Each guide piece 45 of each guide part 40 of the frame 31 extends along an upper and lower direction. An engagement slot 48 is formed on an inner face of each guide piece 45 along the upper and lower direction. A projecting part 49 is formed at a lower end part of the engagement slot 48 of the left guide piece 45. An opening part 50 is formed below the left guide piece 45.

The guide frame 46 of each guide part 40 of the frame 31 extends along the upper and lower direction. A cap plate 51 is arranged at an upper part of the guide frame 46.

Figure 8:
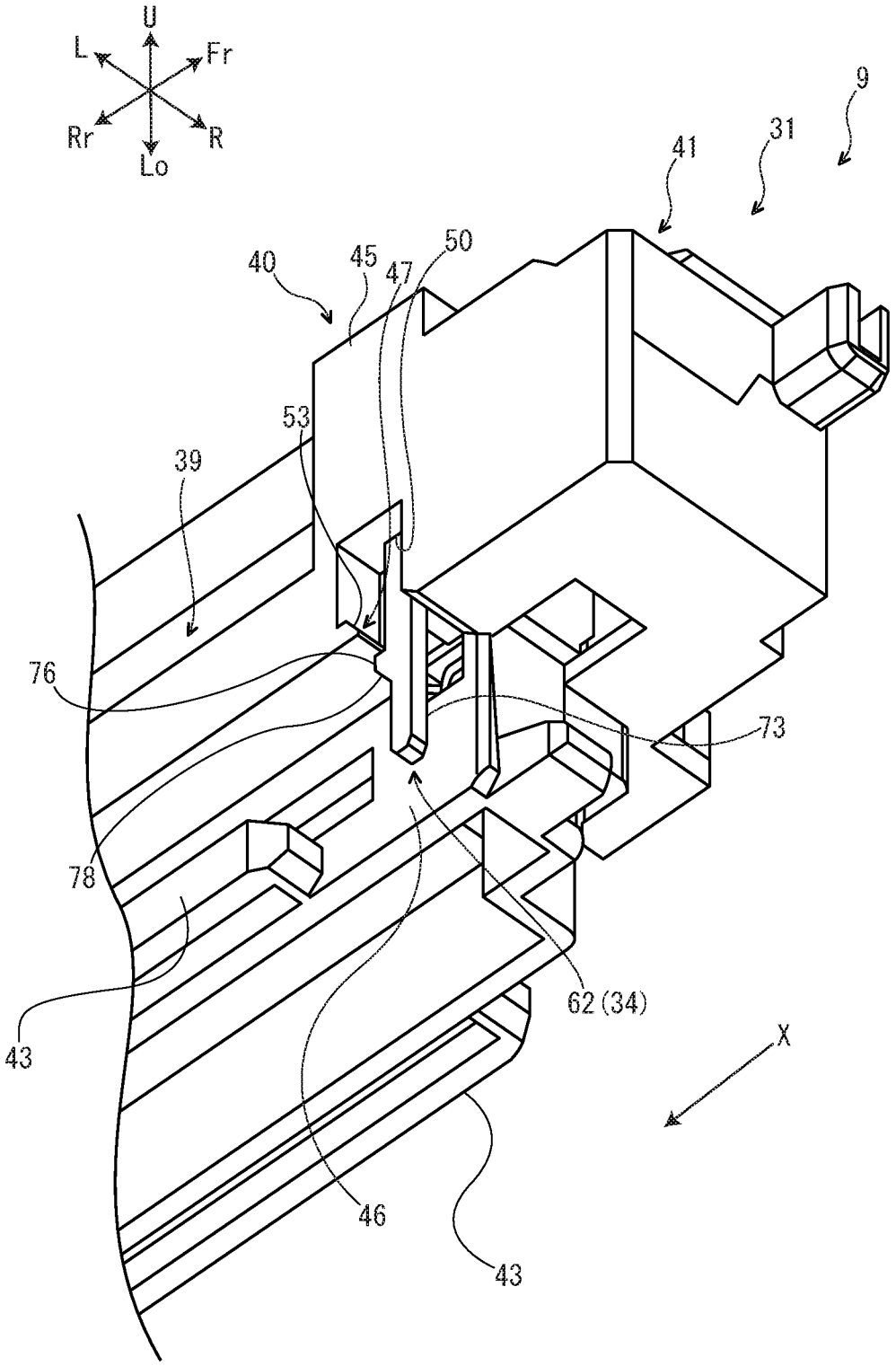
FIG. 8 is a perspective view showing a front part of the charging device according to the embodiment of the present disclosure.
Figure 9:
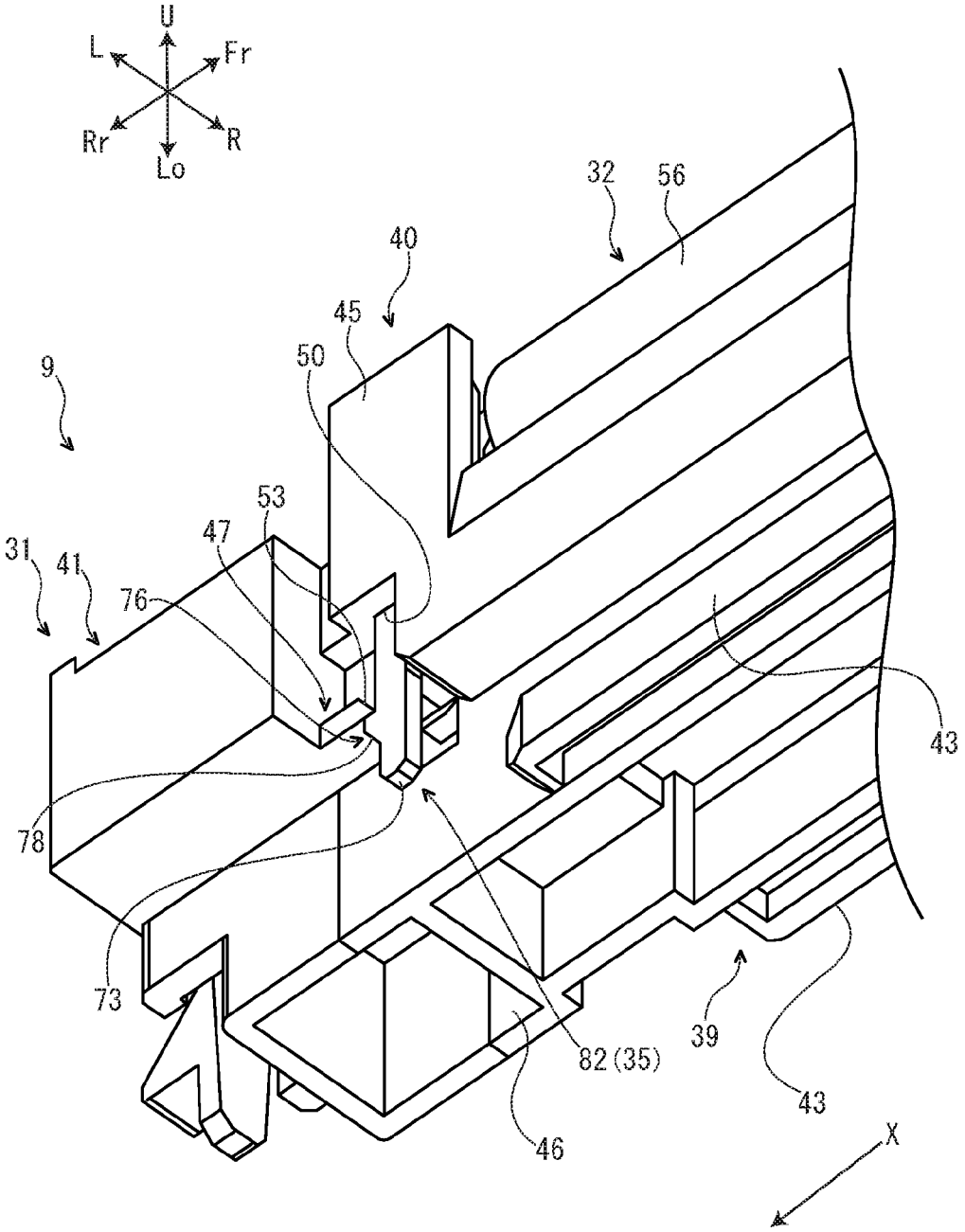
FIG. 9 is a perspective view showing a rear part of the charging device according to the embodiment of the present disclosure.

As shown in FIG. 8 and other figures, the engagement rib 47 of the front guide part 40 of the frame 31 protrudes forward from a lower end part of a front face of the main body part 39 of the frame 31. As shown in FIG. 9 and other figures, the engagement rib 47 of the rear guide part 40 of the frame 31 protrudes forward from a lower end part of a front face of the rear case part 41 of the frame 31. As shown in FIGS. 8 and 9 and other figures, a frame side inclined face 53 is formed on a front face of the engagement rib 47 of each guide part 40. The frame side inclined face 53 inclines to a rear side toward an upper side.

As shown in FIG. 5 and other figures, the charging roller 32 extends along the front and rear direction. The charging roller 32 includes a charging axis 55 and a charging body 56 provided around the charging axis 55. The charging axis 55 is composed of a metal, for example. The charging body 56 is composed of a conductive rubber, for example.

The cleaning roller 33 extends along the front and rear direction. The cleaning roller 33 includes a cleaning axis 58 and a cleaning body 59 provided around the cleaning axis 58. The cleaning axis 58 is composed of a metal, for example. The cleaning body 59 is composed of a spiral sponge, for example.

Figure 10:
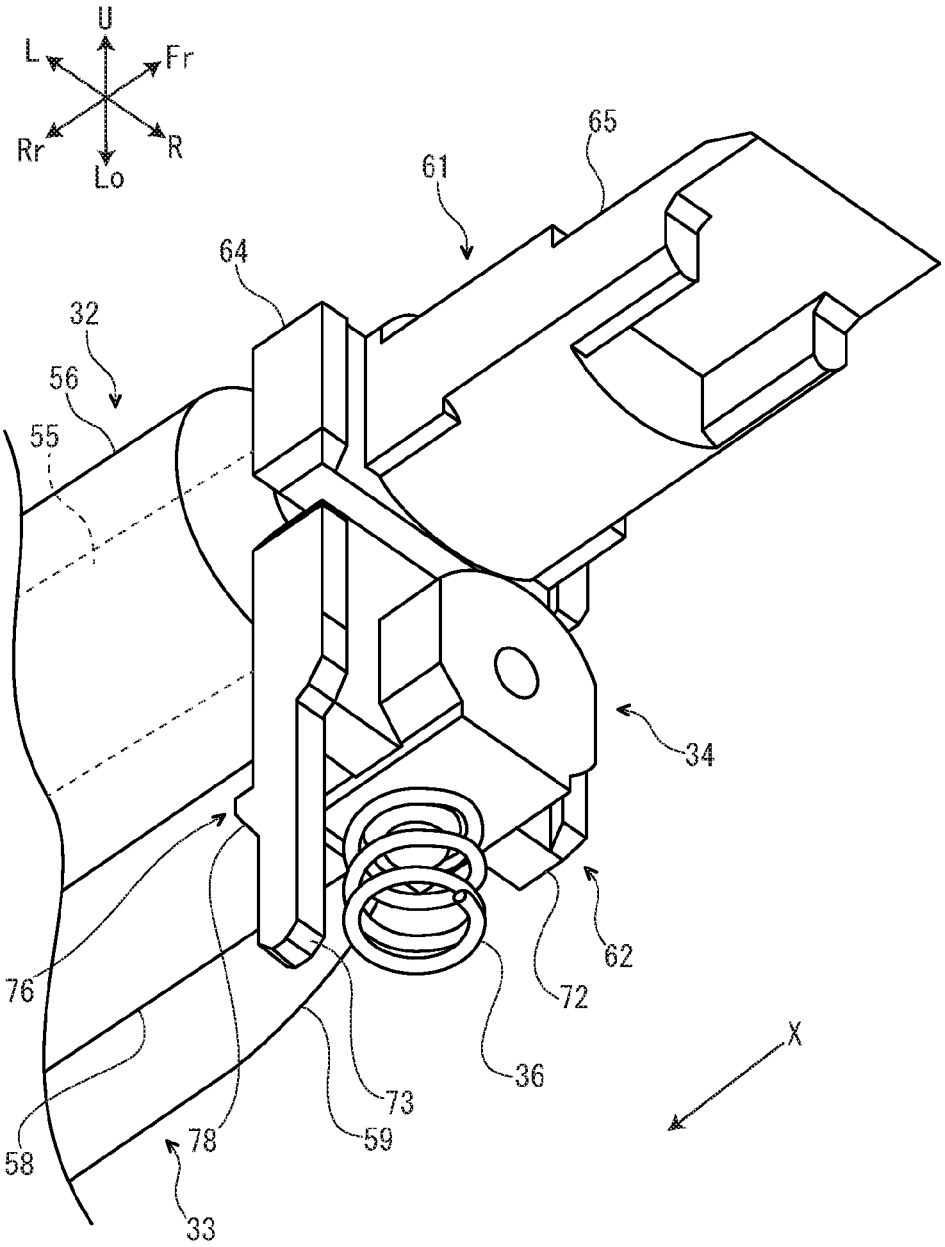
FIG. 10 is a perspective view showing the front side bearing and its periphery, in the charging device according to the embodiment of the present disclosure.

As shown in FIG. 10 and other figures, the front side bearing 34 includes a first bearing part 61, and a second bearing part 62 arranged at a lower side of the first bearing part 61. In other words, the front side bearing 34 is divided into two of the first bearing part 61 and the second bearing part 62.

The first bearing part 61 of the front side bearing 34 includes a first attachment part 64, and an extending part 65 extending forward from the first attachment part 64.

As shown in FIGS. 6 and 7 and other figures, a front end part of the charging axis 55 of the charging roller 32 is attached to the first attachment part 64 of the first bearing part 61 of the front side bearing 34. Thus, the first bearing part 61 rotatably supports the front end part (a near side end part in the attachment direction) of the charging roller 32. The first attachment part 64 engages with the engagement slot 48 formed on each guide piece 45 of the front guide part 40 of the frame 31 in a movable state along the upper and lower direction. Thus, the first bearing part 61 is supported by the front guide part 40 of the frame 31 in a movable state along the upper and lower direction between a first contact position (see FIG. 6 and other figures) to make the charging body 56 of the charging roller 32 come into contact with the photosensitive drum 8 and a first separating position (see FIG. 7 and other figures) to make the charging body 56 of the charging roller 32 separate from the photosensitive drum 8.

The second bearing part 62 of the front side bearing 34 is divided from the first bearing part 61 of the front side bearing 34. In other words, the second bearing part 62 is separately provided from the first bearing part 61.

As shown in FIG. 10 and other figures, the second bearing part 62 of the front side bearing 34 includes a second attachment part 72, and an engagement piece 73 extended from a left end part of the second attachment part 72 to a lower side (a side remote from the first bearing part 61).

As shown in FIGS. 6 and 7 and other figures, a front end part of the cleaning axis 58 of the cleaning roller 33 is attached to the second attachment part 72 of the second bearing part 62 of the front side bearing 34. Thus, the second bearing part 62 rotatably supports a front end part (a near side end part in the attachment direction) of the cleaning roller 33. The second attachment part 72 engages with the engagement slot 48 formed on each guide piece 45 of the front guide part 40 of the frame 31 in a movable state along the upper and lower direction. Thus, the second bearing part 62 is supported by the front guide part 40 of the frame 31 in a movable state along the upper and lower direction between a second contact position (see FIG. 6 and other figures) to make the cleaning body 59 of the cleaning roller 33 come into contact with the charging body 56 of the charging roller 32 and a second separating position (see FIG. 7 and other figures) to make the cleaning body 59 of the cleaning roller 33 separate from the charging body 56 of the charging roller 32.

As shown in FIG. 8 and other figures, the engagement piece 73 of the second bearing part 62 of the front side bearing 34 is exposed to an outside of the frame 31 via the opening part 50 formed in the front guide part 40 of the frame 31. The engagement piece 73 extends along the upper and lower direction. A hook part 76 is protruded on a nearly center part in the upper and lower direction of a rear face (a far side face in the attachment direction) of the engagement piece 73. The hook part 76 is engagable with the engagement rib 47 of the front guide part 40 of the frame 31. A bearing side inclined face 78 is formed on a rear face of the hook part 76. The bearing side inclined face 78 inclines to the rear side toward the upper side.

The front side bearing 34 is switchable between a contact posture (see FIG. 6 and other figures) at which the first bearing part 61 is in the first contact position and the second bearing part 62 is in the second contact position and a separating posture (see FIG. 7 and other figures) at which the first bearing part 61 is in the first separating position and the second bearing part 62 is in the second separating position.

Figure 11:
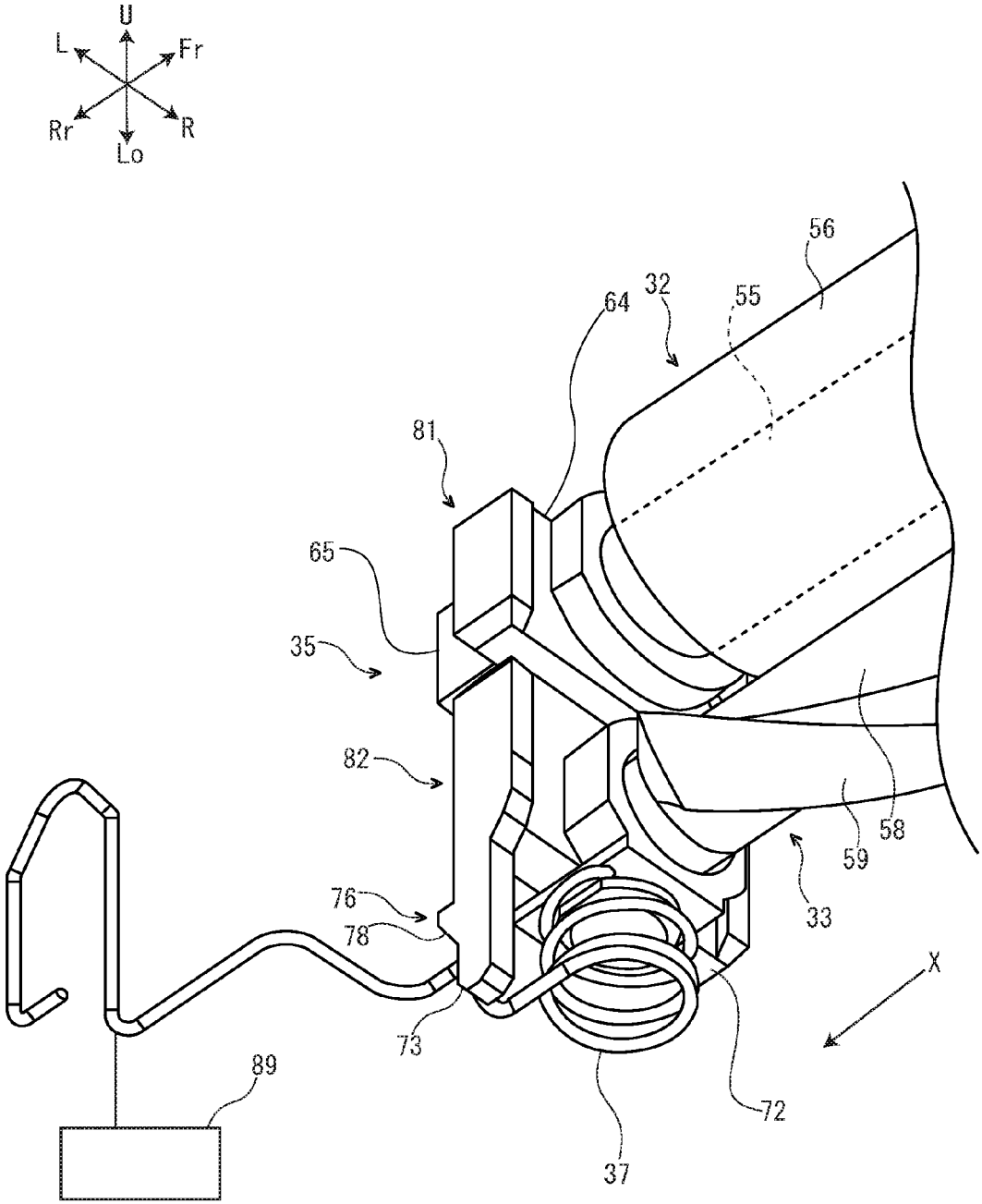
FIG. 11 is a perspective view showing a rear side bearing and its periphery, in the charging device according to the embodiment of the present disclosure.

As shown in FIG. 11 and other figures, the rear side bearing 35 includes a first bearing part 81 and a second bearing part 82 arranged at a lower side of the first bearing part 81. In other words, the rear side bearing 35 is divided into two of the first bearing part 81 and the second bearing part 82.

The first bearing part 81 of the rear side bearing 35 rotatably supports a rear end part (a far side end part in the attachment direction) of the charging roller 32. A configuration of the first bearing part 81 is substantially the same as the configuration of the first bearing part 61 of the front side bearing 34, and therefore will not be described. Incidentally, in FIG. 11, the same reference numerals as those of each part of the first bearing part 61 of the front side bearing 34 are assigned to each part of the first bearing part 81.

The second bearing part 82 of the rear side bearing 35 is divided from the first bearing part 81 of the rear side bearing 35. In other words, the second bearing part 82 is provided separately from the first bearing part 81. The second bearing part 82 rotatably supports a rear end part (a far side end part in the attachment direction) of the cleaning roller 33. A configuration of the second bearing part 82 is substantially the same as the configuration of the second bearing part 62 of the front side bearing 34, and therefore will not be described. In this regard, length in the upper and lower direction of the engagement piece 73 of the second bearing part 82 is shorter than length in the upper and lower direction of the engagement piece 73 of the second bearing part 62 of the front side bearing 34. Incidentally, in FIG. 11, the same reference numerals as those of each part of the second bearing part 62 of the front side bearing 34 are assigned to each part of the second bearing part 82.

Similar to the front side bearing 34, the rear side bearing 35 is switchable between the contact posture at which the first bearing part 81 is in the first contact position and the second bearing part 82 is in the second contact position, and the separating posture at which the first bearing part 81 is in the first separating position and the second bearing part 82 is in the second separating position.

As shown in FIG. 10 and other figures, the front side coil spring 36 presses the second attachment part 72 of the second bearing part 62 of the front side bearing 34 toward the upper side so as to bias the second bearing part 62 of the front side bearing 34 to the second contact position (see FIG. 6 and other figures) and bias the entire front side bearing 34 to the contact posture (see FIG. 6 and other figures).

As shown in FIG. 11 and other figures, the rear side coil spring 37 presses the second attachment part 72 of the second bearing part 82 of the rear side bearing 35 toward the upper side so as to bias the second bearing part 82 of the rear side bearing 35 to the second contact position and bias the entire rear side bearing 35 to the contact posture.

The rear side coil spring 37 is connected with a charging bias applying part 89, and the charging bias applying part 89 is configured to apply a charging bias to the charging roller 32 via the rear side coil spring 37 and the rear side bearing 35. That is, the rear side coil spring 37 has a function as a contact spring which applies the charging bias to the charging roller 32.

Next, the MFP main body 2 will be described in detail.

As shown in FIG. 2 and other figures, the MFP main body 2 is provided with a pair of left and right guide rails 91 (only the left guide rail 91 is shown in FIG. 2). Each guide rail 91 is arranged along the front and rear direction.

As shown in FIG. 3 and other figures, a guide recess part 92 is formed in an inner face of each guide rail 91, and each guide rail 91 is configured to guide the drum unit 20 along the front and rear direction when the elongated protrusion 43 of the main body part 39 of the frame 31 engages with this guide recess part 92.

Figure 12:
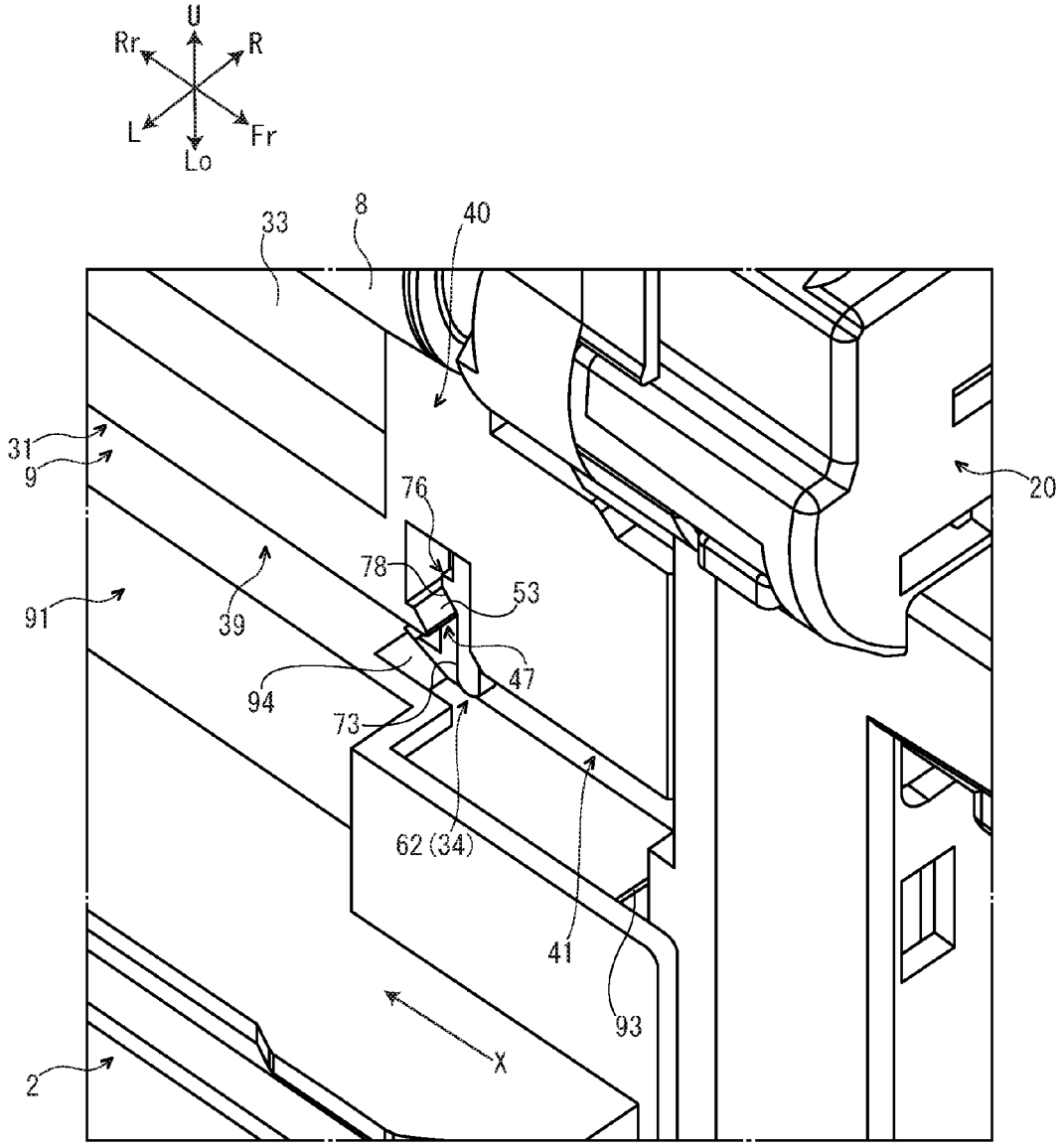
FIG. 12 is a perspective view in which a part B of FIG. 2 is enlarged.

As shown in FIG. 12 and other figures, a front side pressing part 93 (a near side pressing part) is arranged at a front rimpart (a near side rimpart in the attachment direction) of an upper part of the left guide rail 91. A rear side pressing part 94 (a far side pressing part) is arranged on an upper face of the left guide rail 91, and closer to a rear side (the farther side in the attachment direction) than the front side pressing part 93 and closer to an upper side (a closer side to the drum unit 20) than the front side pressing part 93. The rear side pressing part 94 inclines to the upper side toward the rear side.

Next, an operation of charging the photosensitive drum 8 by the charging device 9 in the drum unit 20 configured as mentioned above will be described.

When the charging device 9 charges the photosensitive drum 8, as shown in FIG. 3, the charging body 56 of the charging roller 32 (simply referred to as the "charging roller 32" below) is made to come into contact with the photosensitive drum 8, and the cleaning body 59 of the cleaning roller 33 (simply referred to as the "cleaning roller 33" below) is made to come into contact with the charging roller 32. Further, the charging bias applying part 89 applies the charging bias to the charging roller 32.

In this state, the driving source (not shown) rotates the photosensitive drum 8 (see an arrow A in FIG. 3). According to this, the charging roller 32 rotates with the photosensitive drum 8, and uniformly charges the photosensitive drum 8. Further, the cleaning roller 33 rotates with the charging roller 32 and cleans the charging roller 32.

Next, an operation of attaching the drum unit 20 configured as mentioned above to the MFP main body 2 will be described.

Figure 13:
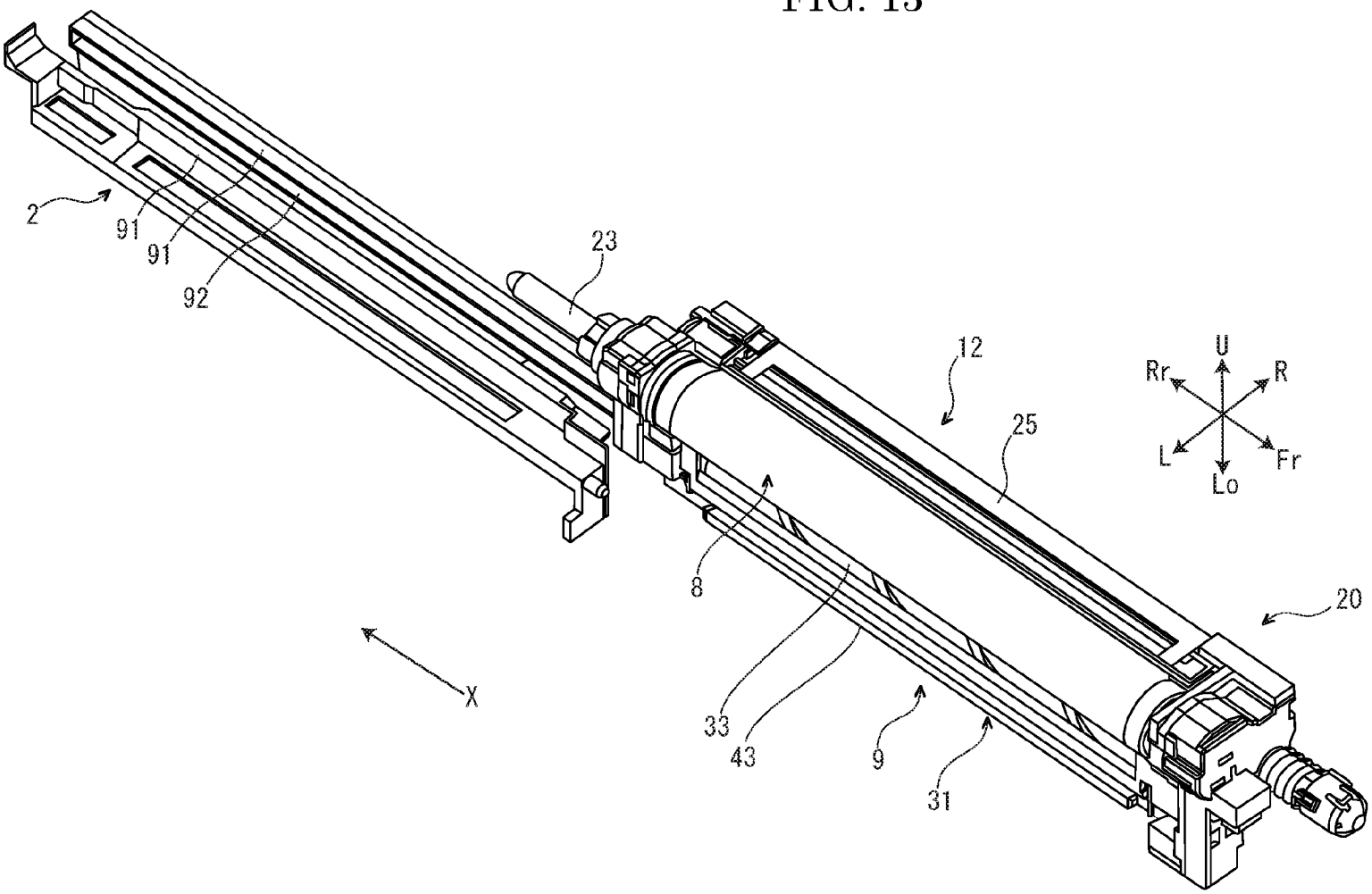
FIG. 13 is a perspective view showing a state before the drum unit is attached to the MFP main body, in the MFP according to the embodiment of the present disclosure.

FIG. 13 shows a state before the drum unit 20 is attached to the MFP main body 2. In this state, as shown in FIGS. 8 and 9, each of the hook parts 76 formed on each of the engagement pieces 73 of the second bearing parts 62 and 82 of each of the bearings 34 and 35 engages with the engagement rib 47 of each guide part 40 of the frame 31. According to this, each of the bearings 34 and 35 is held in the separating posture against biasing force of each of the coil springs 36 and 37. Hence, as shown in FIG. 4 and other figures, the charging roller 32 separates from the photosensitive drum 8, and the cleaning roller 33 separates from the charging roller 32.

Figure 14:
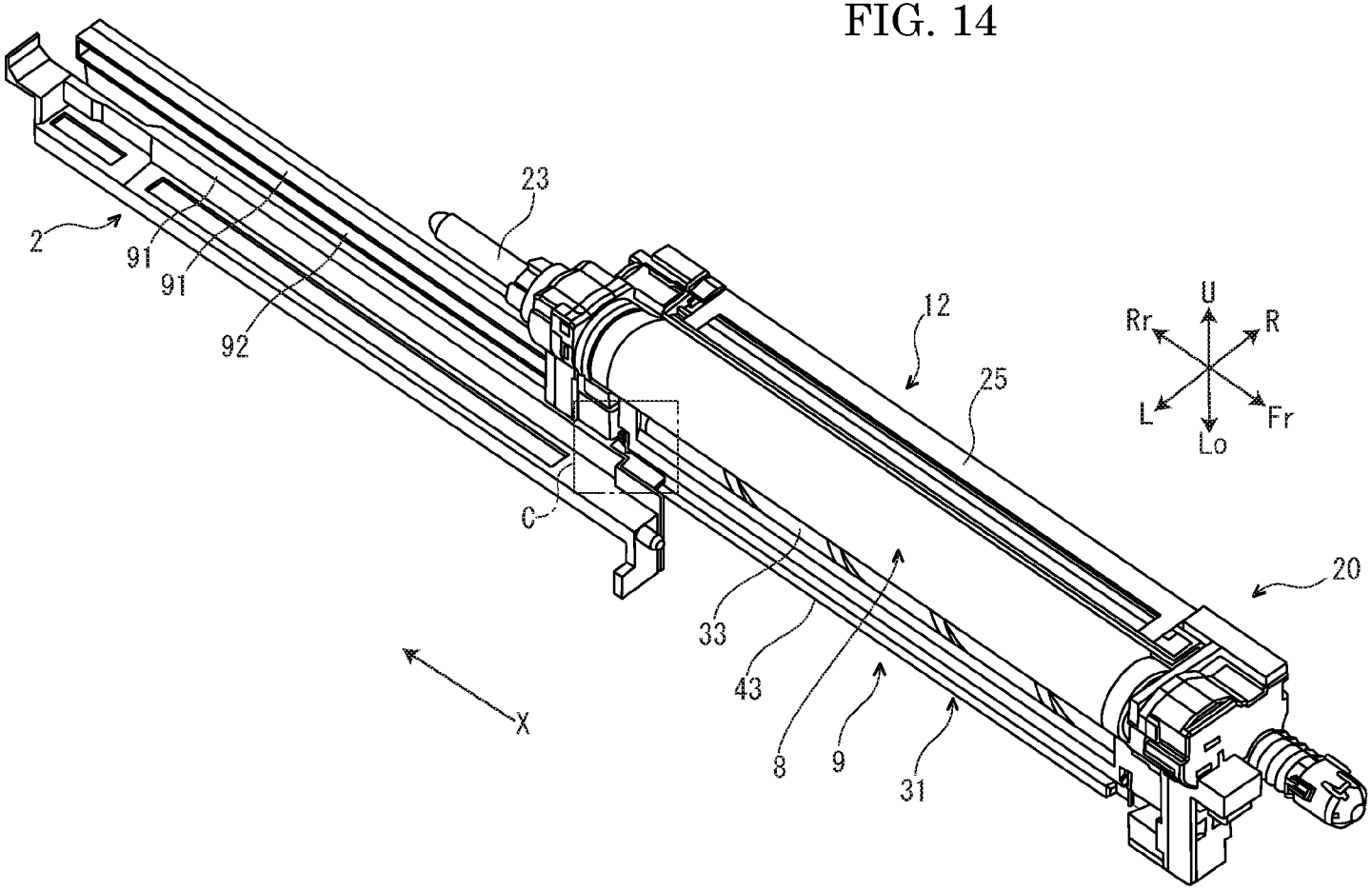
FIG. 14 is a perspective view showing a state right after the attachment of the drum unit to the MFP main body is started, in the MFP according to the embodiment of the present disclosure.
Figure 15:
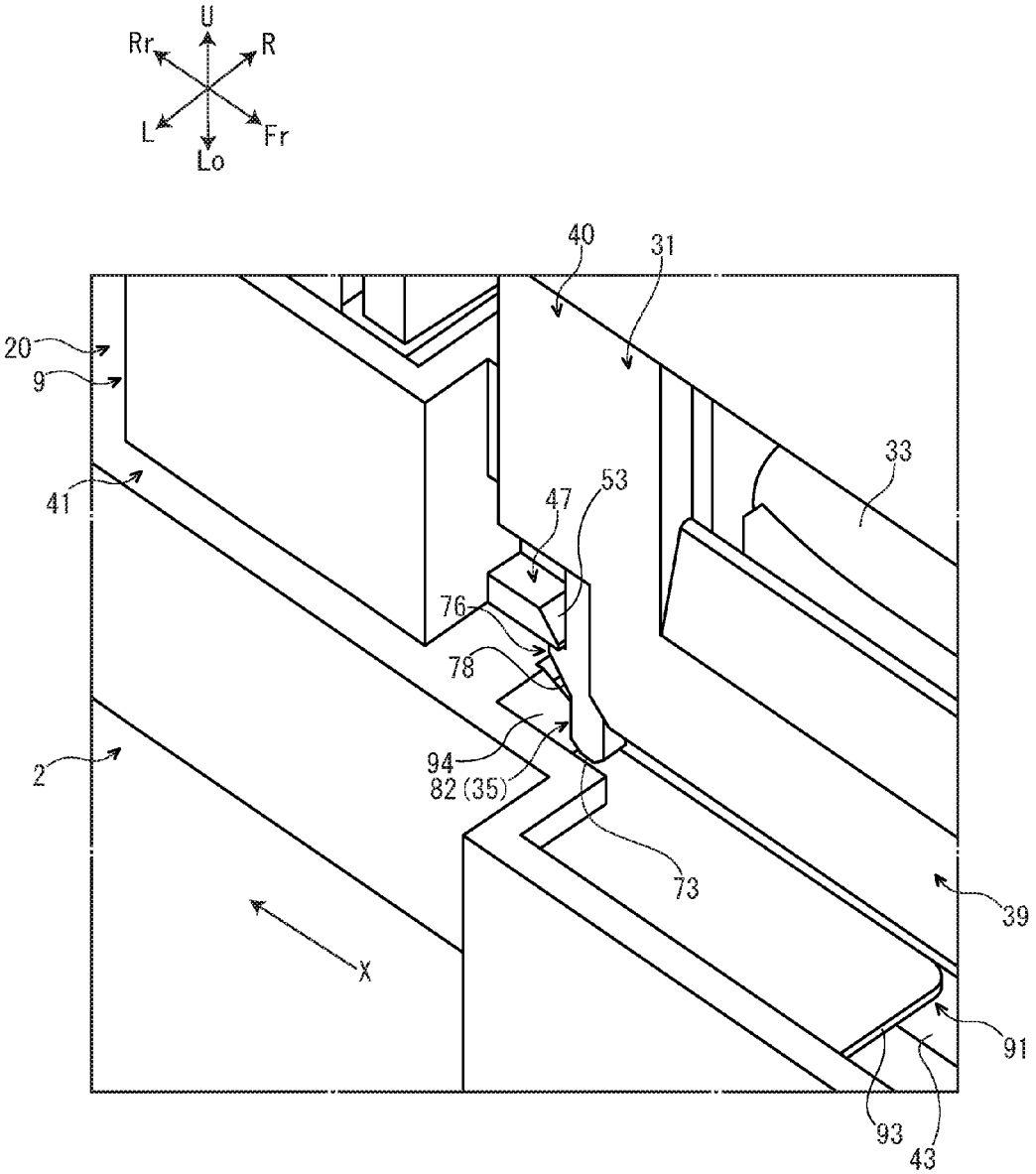
FIG. 15 is a perspective view in which a part C of FIG. 14 is enlarged.

Meanwhile, when the drum unit 20 is pushed from a position shown in FIG. 13 toward the rear side, the drum unit 20 moves toward the rear side as shown in FIG. 14. According to this, as shown in FIG. 15, the rear side pressing part 94 of the left guide rail 91 of the MFP main body 2 comes into contact with the engagement piece 73 of the second bearing part 82 of the rear side bearing 35.

Figure 16:
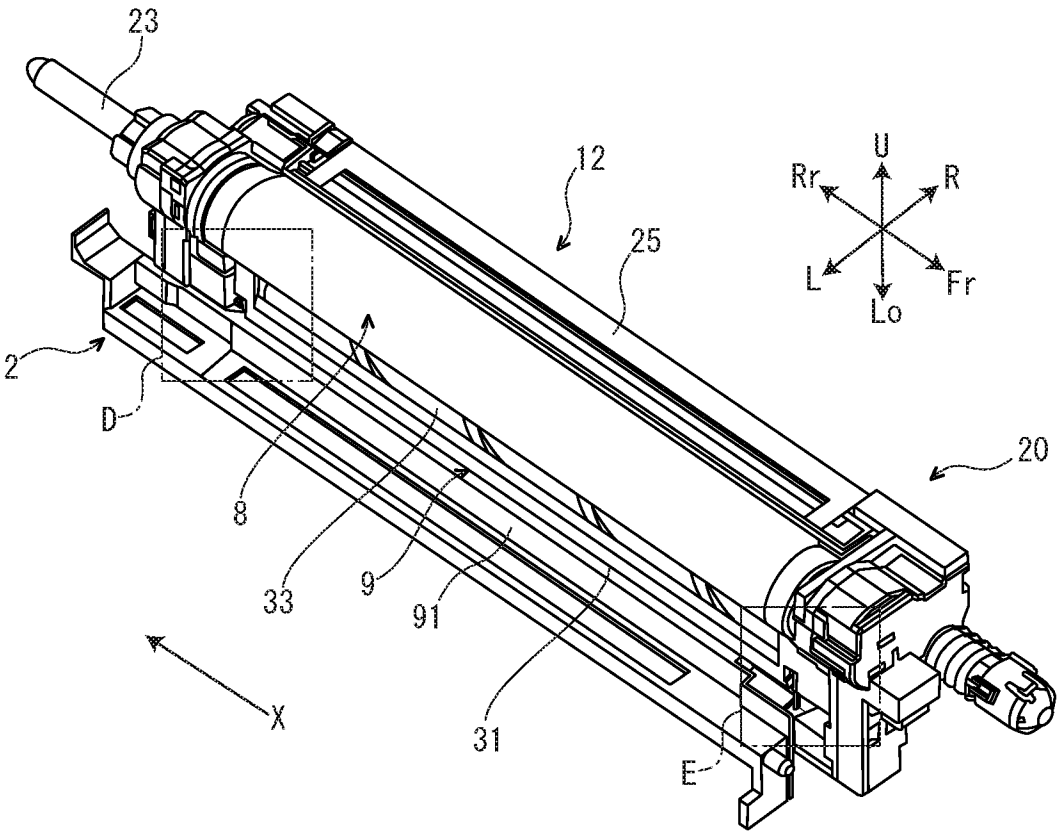
FIG. 16 is a perspective view showing a state right before the attachment of the drum unit to the MFP main body is finished, in the MFP according to the embodiment of the present disclosure.
Figure 17:
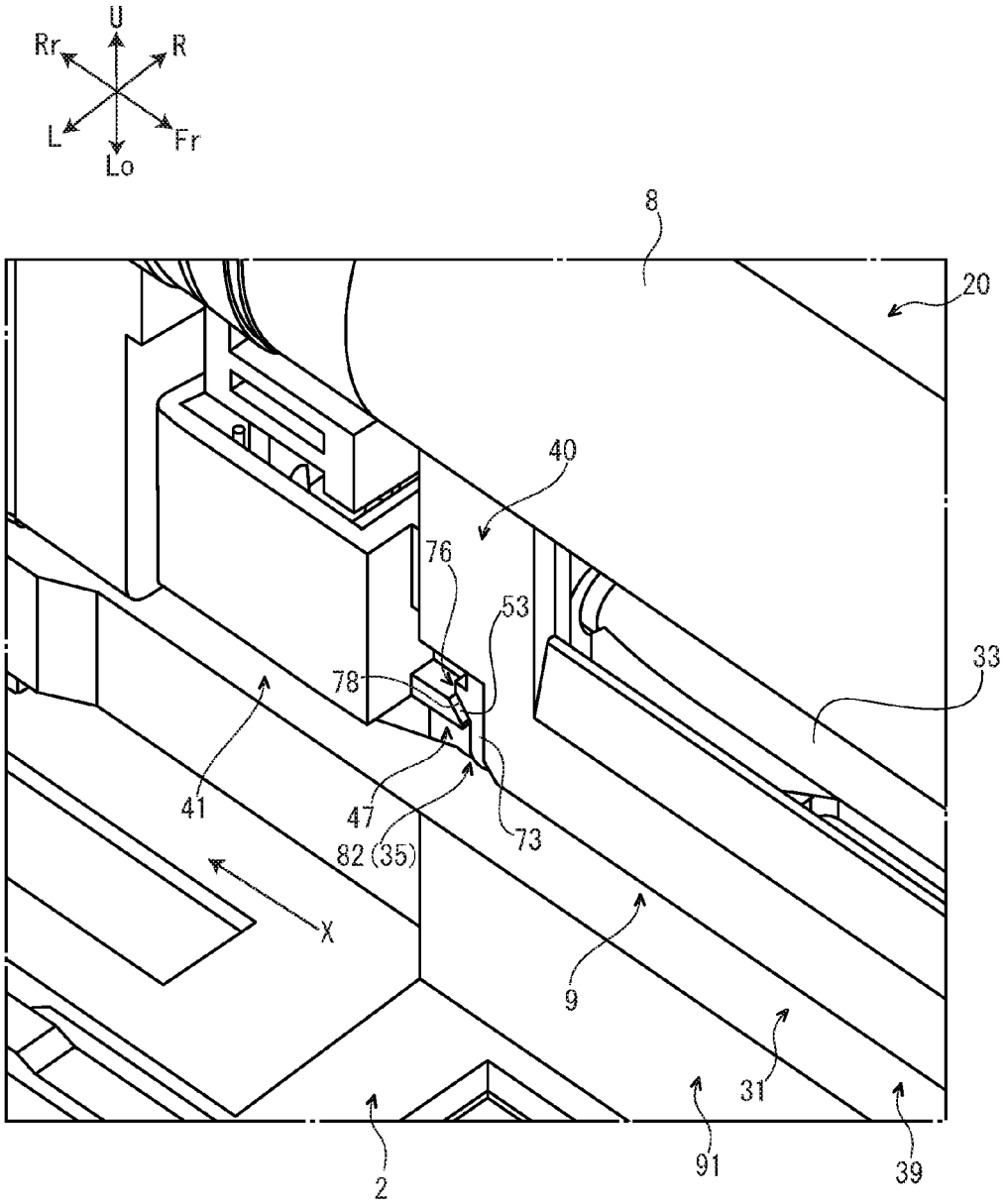
FIG. 17 is a perspective view in which a part D of FIG. 16 is enlarged.

Further, when the drum unit 20 is further pushed from a position shown in FIG. 14 toward the rear side, the drum unit 20 further moves toward the rear side as shown in FIG. 16. According to this, the rear side pressing part 94 of the left guide rail 91 of the MFP main body 2 presses the engagement piece 73 of the second bearing part 82 of the rear side bearing 35 toward the front side. This press elastically deforms the engagement piece 73 of the second bearing part 82 toward the front side, and, as shown in FIG. 17, engagement of the hook part 76 of the engagement piece 73 of the second bearing part 82 with the engagement rib 47 of the rear guide part 40 of the frame 31 is released. Hence, the second bearing part 82 rises from the second separating position to the second contact position by the biasing force of the rear side coil spring 37. According to this, the second bearing part 82 presses the first bearing part 81 upward, and the first bearing part 81 rises from the first separating position to the first contact position. Hence, the rear side bearing 35 is switched from the separating posture to the contact posture.

Figure 18:
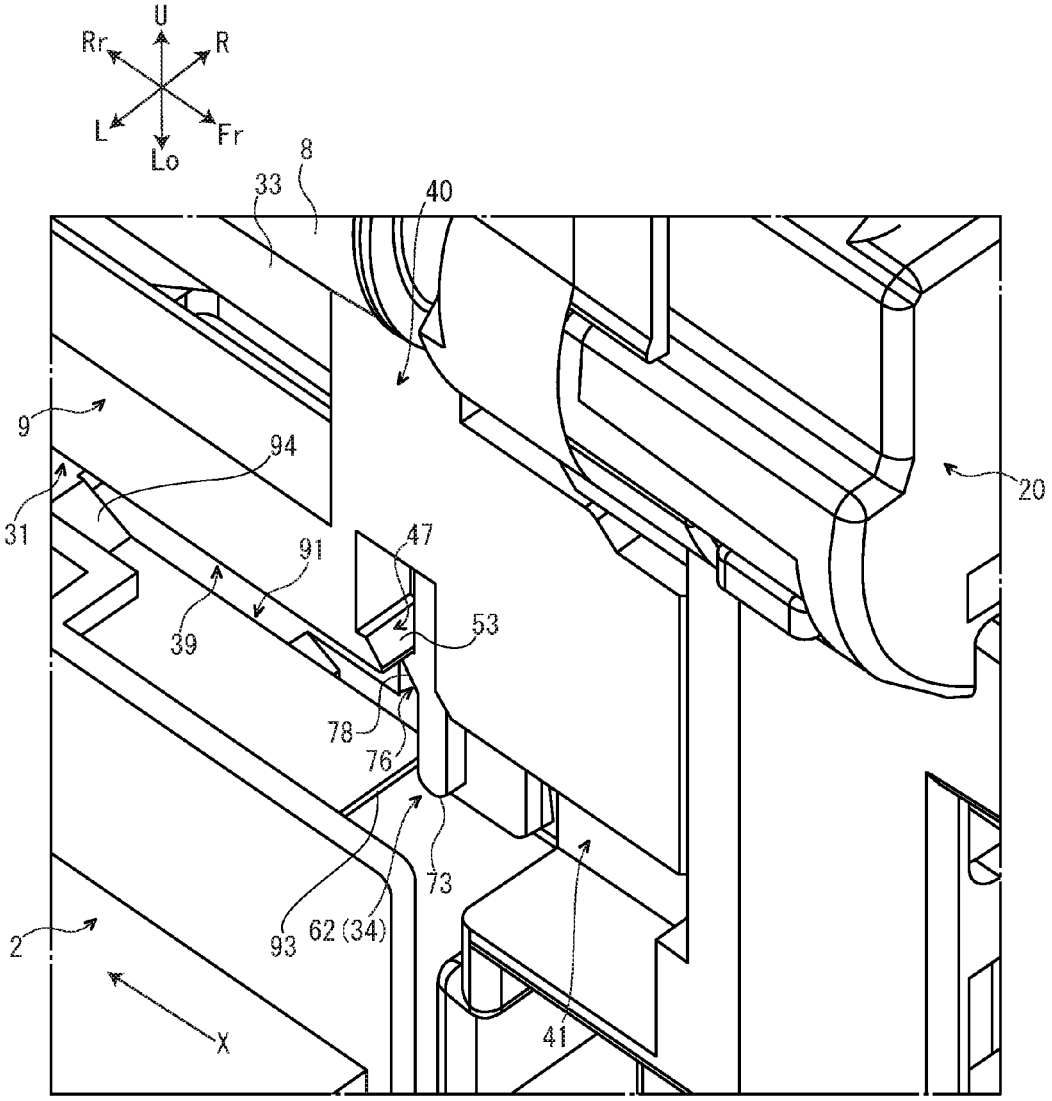
FIG. 18 is a perspective view in which a part E of FIG. 16 is enlarged.

Further, when the drum unit 20 moves to a position shown in FIG. 16 as mentioned above, as shown in FIG. 18, the front side pressing part 93 of the left guide rail 91 of the MFP main body 2 comes into contact with the engagement piece 73 of the second bearing part 62 of the front side bearing 34.

Furthermore, when the drum unit 20 is further pushed from the position shown in FIG. 16 toward the rear side, as shown in FIG. 2, the drum unit 20 further moves toward the rear side and attachment of the drum unit 20 to the MFP main body 2 is finished. According to this, the front side pressing part 93 of the left guide rail 91 of the MFP main body 2 presses the engagement piece 73 of the second bearing part 62 of the front side bearing 34 toward the front side. This press elastically deforms the engagement piece 73 of the second bearing part 62 toward the front side, and, as shown in FIG. 12, the engagement of the hook part 76 of the engagement piece 73 of the second bearing part 62 with the engagement rib 47 of the front guide part 40 of the frame 31 is released. Hence, as shown in FIG. 6 and other figures, the second bearing part 62 rises from the second separating position to the second contact position by the biasing force of the front side coil spring 36. According to this, the second bearing part 62 presses the first bearing part 61 upward, and the first bearing part 61 rises from the first separating position to the first contact position. Hence, the front side bearing 34 switches from the separating posture to the contact posture.

When each of the bearings 34 and 35 switches from the separating posture to the contact posture as mentioned above, as shown in FIG. 3 and other figures, the charging roller 32 comes into contact with the photosensitive drum 8 and the cleaning roller 33 comes into contact with the charging roller 32. Thus, the charging device 9 is in a state to be able to charge the photosensitive drum 8.

In the present embodiment, as mentioned above, in a state before the drum unit 20 is attached to the MFP main body 2, the charging roller 32 is separated from the photosensitive drum 8 and the cleaning roller 33 is separated from the charging roller 32. Consequently, it is possible to suppress deformation over time of the photosensitive drum 8, the charging roller 32 and the cleaning roller 33, improve charging performance of the photosensitive drum 8 and prevent a defective image.

Further, as the drum unit 20 is attached to the MFP main body 2, the charging roller 32 is made automatically to come into contact with the photosensitive drum 8, and the cleaning roller 33 is made automatically to come into contact with the charging roller 32. Hence, compared to a case where an operator performs manual operation of making the charging roller 32 come into contact with the photosensitive drum 8 and making the cleaning roller 33 come into contact with the charging roller 32, it is possible to improve operability to set up the MFP 1.

Further, each of the pressing parts 93 and 94 is provided at the left guide rail 91 of the MFP main body 2. By applying such a configuration, the left guide rail 91 which guides the drum unit 20 along the front and rear direction can also be used as a member which presses each of the bearings 34 and 35. Consequently, it is possible to prevent the configuration of the MFP 1 from being complicated.

Further, in a state before the drum unit 20 is attached to the MFP main body 2, the engagement piece 73 engages with the engagement rib 47, so that each of the bearings 34 and 35 is held in the separating posture against the biasing force of each of the coil springs 36 and 37, and, as the drum unit 20 is attached to the MFP main body 2, each of the pressing parts 93 and 94 presses the engagement piece 73, and the engagement of the engagement piece 73 with the engagement rib 47 is released, so that each of the bearings 34 and 35 is switched from the separating posture to the contact posture by the biasing force of each of the coil springs 36 and 37. By applying such a configuration, it is possible to switch each of the bearings 34 and 35 from the separating posture to the contact posture by using a simple configuration.

Further, the bearings 34 and 35 include the first bearing parts 61 and 81 which rotatably support the charging roller 32 and the second bearing parts 62 and 82 which rotatably support the cleaning roller 33, and the engagement pieces 73 are arranged on the second bearing parts 62 and 82. By applying such a configuration, it is easy to expose parts of the engagement pieces 73 to the outside of the frame 31 and make the pressing parts 93 and 94 press the engagement pieces 73.

Further, the rear side pressing part 94 is arranged closer to the rear side (the farther side in the attachment direction) than the front side pressing part 93 and closer to the upper side (the closer side to the drum unit 20) than the front side pressing part 93. By applying such a configuration, as the drum unit 20 is attached to the MFP main body 2, it is possible to reliably switch both of the front side bearing 34 and the rear side bearing 35 from the separating postures to the contact postures.

In the present embodiment, each pressing part 93, 94 is arranged at the left guide rail 91 of the MFP main body 2. In other embodiments, each pressing part 93, 94 may be arranged at a part other than each guide rail 91 of the MFP main body 2.

In the present embodiment, the second bearing part 62, 82 of each bearing 34, 35 is divided from the first bearing part 61, 81 of each bearing 34, 35. In other embodiments, the second bearing part 62, 82 of each bearing 34, 35 may be arranged integrally with the first bearing part 61, 81 of each bearing 34, 35.

In the present embodiment, the cleaning body 59 of the cleaning roller 33 is composed of a sponge. In other embodiments, the cleaning body 59 of the cleaning roller 33 may be composed of a brush or the like.

In the present embodiment, the configuration of the present disclosure is applied to the MFP 1. In other embodiments, the configuration of the present disclosure may be applied to an image forming apparatus other than the MFP 1, such as a printer, a copying machine, or a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a unit including a charging member configured to charge an image carrier and a bearing configured to rotatably support the charging member; and an apparatus main body to which the unit is attached along an attachment direction, wherein the bearing is switchable between a contact posture to make the charging member come into contact with the image carrier and a separating posture to make the charging member separate from the image carrier, and in a state before the unit is attached to the apparatus main body, the bearing is held in the separating posture, and as the unit is attached to the apparatus main body, a pressing part arranged on the apparatus main body presses the bearing and the bearing is switched from the separating posture to the contact posture, wherein the unit further includes:

a biasing member configured to bias the bearing to the contact posture; and a frame configured to hold the bearing, and the bearing includes an engagement piece which is engagable with an engagement rib arranged on the frame, and in the state before the unit is attached to the apparatus main body, the engagement piece engages with the engagement rib so that the bearing is held in the separating posture against biasing force of the biasing member, and as the unit is attached to the apparatus main body, the pressing part presses the engagement piece and engagement of the engagement piece with the engagement rib is released so that the bearing is switched from the separating posture to the contact posture by the biasing force of the biasing member.

2. The image forming apparatus according to claim 1, wherein the apparatus main body includes a guide rail configured to guide the unit along the attachment direction, and the pressing part is arranged on the guide rail.

3. The image forming apparatus according to claim 1, wherein the unit further includes a cleaning member configured to clean the charging member, and the bearing includes:

a first bearing part configured to rotatably support the charging member; and a second bearing part configured to rotatably support the cleaning member, and the engagement piece is arranged on the second bearing part.

4. The image forming apparatus according to claim 1, wherein a hook part which engages with the engagement rib is protruded on a far side face in the attachment direction of the engagement piece.

5. The image forming apparatus according to claim 1, further comprising a charging bias applying part connected with the biasing member, wherein the charging bias applying part is configured to apply a charging bias to the charging member via the biasing member and the bearing.

6. An image forming apparatus comprising:

a unit including a charging member configured to charge an image carrier and a plurality of bearings configured to rotatably support the charging member; and an apparatus main body to which the unit is attached along an attachment direction, wherein the plurality of bearings are switchable between a contact posture to make the charging member come into contact with the image carrier and a separating posture to make the charging member separate from the image carrier, and in a state before the unit is attached to the apparatus main body, the plurality of bearings are held in the separating posture, and as the unit is attached to the apparatus main body, a plurality of pressing parts arranged on the apparatus main body press the plurality of bearings and the plurality of bearings are switched from the separating posture to the contact posture, wherein the plurality of bearings include a near side bearing configured to rotatably support a near side end part in the attachment direction of the charging member and a far side bearing configured to rotatably support a far side end part in the attachment direction of the charging member, and the plurality of pressing parts include a near side pressing part configured to press the near side bearing and a far side pressing part configured to press the far side bearing, and the far side pressing part is arranged at a farther side in the attachment direction than the near side pressing part and at a closer side to the unit than the near side pressing part.

* * * * *